US010531746B2

(12) United States Patent
Vesey

(10) Patent No.: US 10,531,746 B2
(45) Date of Patent: Jan. 14, 2020

(54) MODULAR MATTRESS

(71) Applicant: Donald C. Vesey, Union City, CA (US)

(72) Inventor: Donald C. Vesey, Union City, CA (US)

( * ) Notice: Subject to any disclaimer, the term of this patent is extended or adjusted under 35 U.S.C. 154(b) by 0 days.

(21) Appl. No.: 15/628,647

(22) Filed: Jun. 21, 2017

(65) Prior Publication Data

US 2018/0008050 A1 Jan. 11, 2018

Related U.S. Application Data

(60) Provisional application No. 62/353,020, filed on Jun. 21, 2016.

(51) Int. Cl.

| | |
|---|---|
| ***A47C 27/15*** | (2006.01) |
| ***A47C 27/14*** | (2006.01) |
| ***A47C 27/18*** | (2006.01) |
| ***A47C 31/08*** | (2006.01) |
| ***A47C 27/06*** | (2006.01) |
| ***A47C 27/08*** | (2006.01) |

(52) U.S. Cl.

CPC ..... *A47C 27/15* (2013.01); *A47C 27/06* (2013.01); *A47C 27/081* (2013.01); *A47C 27/148* (2013.01); *A47C 27/18* (2013.01); *A47C 31/08* (2013.01)

(58) Field of Classification Search

CPC ..... A47C 27/15; A47C 27/06; A47C 27/16; A47C 27/148

See application file for complete search history.

(56) References Cited

U.S. PATENT DOCUMENTS

| | | | | | |
|---|---|---|---|---|---|
| 2,721,339 | A * | 10/1955 | Crockett | A47C 27/001 | 5/722 |
| 3,534,417 | A * | 10/1970 | Boyles | A47C 27/148 | 5/727 |
| 4,476,594 | A * | 10/1984 | McLeod | A47C 21/06 | 5/701 |
| 4,794,658 | A * | 1/1989 | Goodale | A47C 27/05 | 5/669 |
| 5,136,741 | A * | 8/1992 | Balonick | A47C 27/001 | 5/699 |
| 5,513,402 | A * | 5/1996 | Schwartz | A47C 23/00 | 5/691 |
| 5,669,094 | A * | 9/1997 | Swanson | A47C 27/14 | 5/740 |
| 5,745,940 | A * | 5/1998 | Roberts | A47C 27/001 | 5/727 |
| 5,953,779 | A * | 9/1999 | Schwartz | A47C 27/001 | 5/692 |
| 5,960,496 | A * | 10/1999 | Boyd | A47C 27/144 | 5/722 |
| 6,159,574 | A * | 12/2000 | Landvik | A47C 27/15 | 428/71 |
| 8,832,889 | B2 * | 9/2014 | Sportis | A47C 27/144 | 5/727 |

(Continued)

*Primary Examiner* — Eric J Kurilla
(74) *Attorney, Agent, or Firm* — Larisa Migachyov

(57) ABSTRACT

A mattress is disclosed, comprising two layers—a first layer and a second layer—each layer comprising a top surface and a bottom surface that are distinct in firmness, feel, and/or other parameters relevant to sleeping. The first layer and the second layer are stacked on top of each other and may easily be flipped and re-stacked by a user in the home.

9 Claims, 3 Drawing Sheets

(56) References Cited

U.S. PATENT DOCUMENTS

2003/0109908 A1* 6/2003 Lachenbruch ..... A47C 21/046 607/96
2003/0177584 A1* 9/2003 Boyd ..... A47C 27/144 5/727
2004/0128774 A1* 7/2004 Chen ..... A47C 23/14 5/740
2004/0237206 A1* 12/2004 Webster ..... A47C 21/046 5/727
2005/0084667 A1* 4/2005 Landvik ..... A47C 27/15 428/316.6
2006/0048304 A1* 3/2006 Boyd ..... A47C 21/048 5/738
2006/0288490 A1* 12/2006 Mikkelsen ..... A47C 7/022 5/740
2007/0056096 A1* 3/2007 Assink ..... A47C 27/14 5/81.1 HS
2008/0201856 A1* 8/2008 Howard ..... A47C 27/001 5/690
2008/0256706 A1* 10/2008 Larsen ..... A47C 21/08 5/425
2008/0301983 A1* 12/2008 Murphy ..... A47C 27/08 40/360
2009/0165213 A1* 7/2009 Collins ..... A47C 7/022 5/740
2010/0058541 A1* 3/2010 Kemper ..... A47C 27/001 5/701
2014/0059779 A1* 3/2014 Antinori ..... A47C 31/08 5/703
2014/0090178 A1* 4/2014 Morgan ..... A47C 27/148 5/740
2015/0040327 A1* 2/2015 Mikkelsen ..... A47C 27/15 5/740
2015/0182031 A1* 7/2015 Jensen ..... A47G 9/0238 5/690
2015/0265063 A1* 9/2015 Cappadona ..... A47C 27/002 5/698
2015/0296993 A1* 10/2015 Boyd ..... A47C 21/046 5/665
2017/0224126 A1* 8/2017 O'Connell, Jr. ..... A47C 27/148
2017/0325597 A1* 11/2017 Carlitz ..... A47C 27/15

* cited by examiner

MODULAR MATTRESS

CROSS-REFERENCE TO RELATED APPLICATIONS

The present application takes priority from Provisional App. No. 62/353,020, filed Jun. 21, 2016, which is incorporated herein by reference.

BACKGROUND

Field of the Invention

The present invention pertains generally to mattresses, and more particularly to mattresses that are modifiable by the user.

Background of the Invention

A good mattress is extremely important for a good night's sleep, and people differ greatly in what kind of mattress they prefer. Some people like a firmer sleeping surface; some like a softer one. Some people also prefer differing surface feels, such as memory foam, latex, gel, and so on. Also, as a person ages, becomes ill, or goes through other bodily changes (such as pregnancy), their mattress requirements often change.

Since mattresses are very unwieldy and expensive, it is not practical to accommodate such changes in sleep requirements. It is impractical to store several mattresses at an average home.

Some prior art exists on the subject of adjustable mattresses—typically, multilayer mattresses where the layers are arranged and configured before the mattress is sold to a consumer. However, it is near impossible for a consumer to rearrange the layers when their sleep requirements change during normal use (i.e. a houseguest coming to stay, a sudden illness, or even a simple change in preference). In some prior art references, multiple elements are provided that are interchangeable, but the extra elements need to be stored somewhere.

A need exists for an adjustable mattress that can easily be configured and reconfigured by a consumer in the home to provide a variety of surface feels and firmness.

SUMMARY OF THE INVENTION

An object of the present invention is to provide a mattress whose firmness and surface feel can be easily changed by a consumer in the home.

Another object of the present invention is to provide a mattress whose firmness and surface feel can be changed by a consumer in the home, wherein the mattress is constructed simply and cheaply.

Another object of the present invention is to provide a mattress whose firmness and surface feel can be changed by a consumer in the home, wherein no extra elements are ever left over, requiring extra storage.

The mattress of the present invention comprises two separate layers that can be stacked on top of each other in any order. The first layer comprises a top surface and a bottom surface; the second layer comprises a top surface and a bottom surface. The first layer and the second layer have approximately the same length and approximately the same width. The top surface of the first layer, the bottom surface of the first layer, the top surface of the second layer, and the bottom surface of the second layer, all have different firmness levels.

In an embodiment, the top surface of the first layer has a visual appearance that is distinct from the bottom surface of the first layer, and the top surface of the second layer has a visual appearance that is distinct from the bottom surface of the second layer. The visual appearance may relate to color or pattern or both.

In an embodiment, the mattress further comprises a non-slip sheet to be placed between the first layer and the second layer when the two are stacked on top of each other. The non-slip sheet can be Velcro, non-slip rubber, or any other friction-enhancing material.

The top surface of the first layer, the bottom surface of the first layer, the top surface of the second layer, and the bottom surface of the second layer, may be one of the following group: innersprings, memory foam, latex foam, gel, memory foam, firm high-density foam, soft high-density foam. Each surface of each layer is distinct and different from all the other surfaces.

In an embodiment, at least one of the first layer and second layer comprises at least one handle. Preferably, both layers comprise handles, and the handles are located at ⅓ and ⅔ points along the length of the long side of each layer.

In an embodiment, the thickness of the first layer and the thickness of the second layer add up to approximately the thickness of a standard mattress.

LIST OF FIGURES

DETAILED DESCRIPTION OF THE PREFERRED EMBODIMENT

For purposes of the present disclosure, a "layer" is a self-contained part of a modular mattress with surfaces that may have distinct firmness levels.

Figure 1:
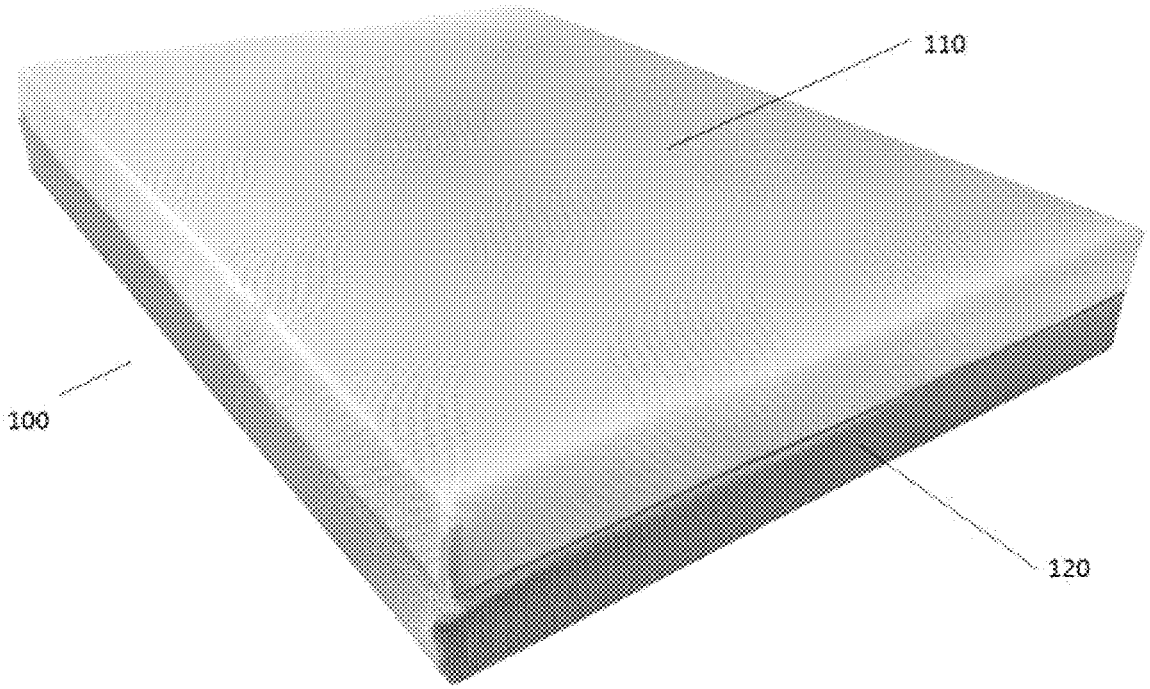
FIG. 1 shows a view of an embodiment of the present invention.

FIG. 1 shows the preferred embodiment of the present invention. As can be seen, a mattress 100 is provided that comprises a first layer 110 and a second layer 120. The first layer 110 and the second layer 120 are roughly parallelepiped in shape. The first layer 110 is stacked on the second layer 120. A friction-enhancing sheet (not shown) is placed between the two layers; in some embodiments, the friction-enhancing sheet is not used.

As can be seen in the Figure, each layer has a top side and a bottom side, which are distinct from each other in feel and/or surface hardness. Each layer may be placed on top or on the bottom, depending on consumer preference; i.e. the first layer 110 may be placed on top of the second layer 120 or the second layer 120 may be placed on top of the first layer 110. This results in eight possible mattress configurations with no parts left over. The only work that the consumer has to do to reconfigure the mattress is to flip over and/or re-stack the two layers.

In the preferred embodiment, the dimensions of the two layers, when stacked together, are preferably the same as the dimensions of a standard mattress, to make it easier to use standard sheets on the mattress of the present invention. Any standard mattress dimensions—i.e. twin, full, queen, king, California king, or any other standard dimensions—may be used for the present invention.

Figure 2:
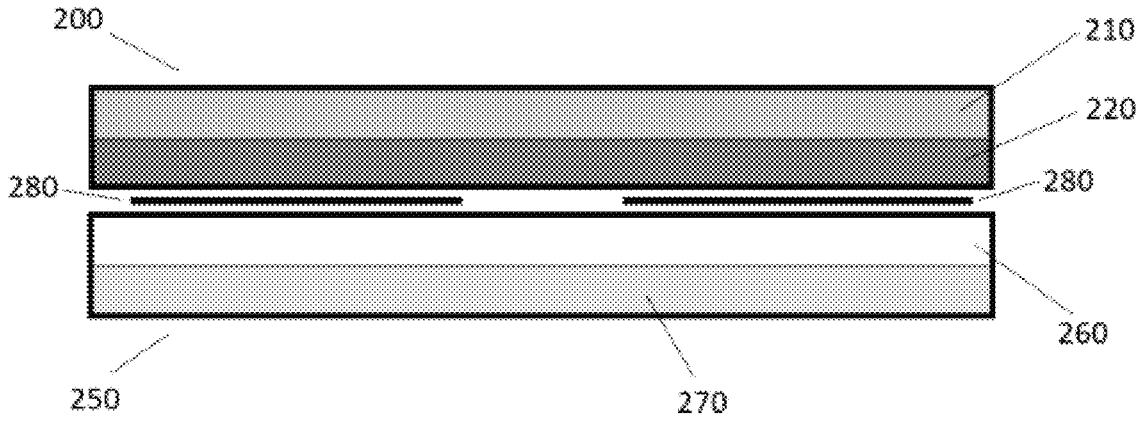
FIG. 2 shows a view of an embodiment of the present invention from the side.

While it is understood that the first layer and the second layer can have any softness/hardness levels or any other parameters on their top and bottom sides, FIG. 2 shows one possible embodiment of the present invention. The first layer 200 comprises a latex sleeping surface 210 on the top side and a gel memory sleeping surface 220 on the bottom side. The second layer 250 comprises a firm high-density foam 260 on the top side and a soft high-density foam 270 on the bottom side. As shown in the Figure, this allows the user to easily create eight different mattress types—a firm high-density foam mattress with a gel base, a firm high-density foam mattress with a latex base, a soft high-density foam mattress with a gel base, a soft high-density foam mattress with a latex base, a latex-topped mattress with a firm base, a latex-topped mattress with a soft base, a gel-topped mattress with a firm base, and a gel-topped mattress with a soft base. The only thing the user has to do to change the mattress type is flip one or both of the layers or move one from bottom to top or vice versa.

In the preferred embodiment, one or more nonslip sheets 280 are placed between the first layer and the second layer to prevent slipping. The nonslip sheets are preferably non-skid pads such as those used for carpeting or furniture, but could also be Velcro or any other material that prevents one layer from slipping on the other layer.

In the preferred embodiment, the top and bottom sides of each layer are different colors to indicate which texture/softness is which. As shown in the Figure, the latex side of the first layer has a dark top panel and the gel side of the first layer has a light top panel; the first layer has a light side border. The firm side of the second layer has a dark top panel and the soft side of the second layer has a light top panel, and the second layer has a dark side border. It will be understood that this is simply an example of the type of color labeling that could be used, and that any colors, patterns, or combinations of colors and patterns, may be used to distinguish the different sides.

While the first layer as shown in the Figure comprises gel and latex as the two types of sleeping surface, it will be understood that any other sleeping surfaces may be used on either or both sides of either layer. For example, innersprings, memory foam, latex foam, and so on may all be used. Furthermore, while the second layer in the Figure comprises hard foam and soft foam as the two sides, it may also comprise innersprings, air or water compartments, gel, memory foam, and so on. In the preferred embodiment, half of the thickness of each layer is used for each texture—i.e. for a given layer, half the thickness may be comprised of gel and half of memory foam, and so on. In some embodiments, different percentages of the total thickness of each layer are used for each texture—for example, 75% of a layer may be comprised of innersprings and 25% of gel, and so on.

Figure 3:
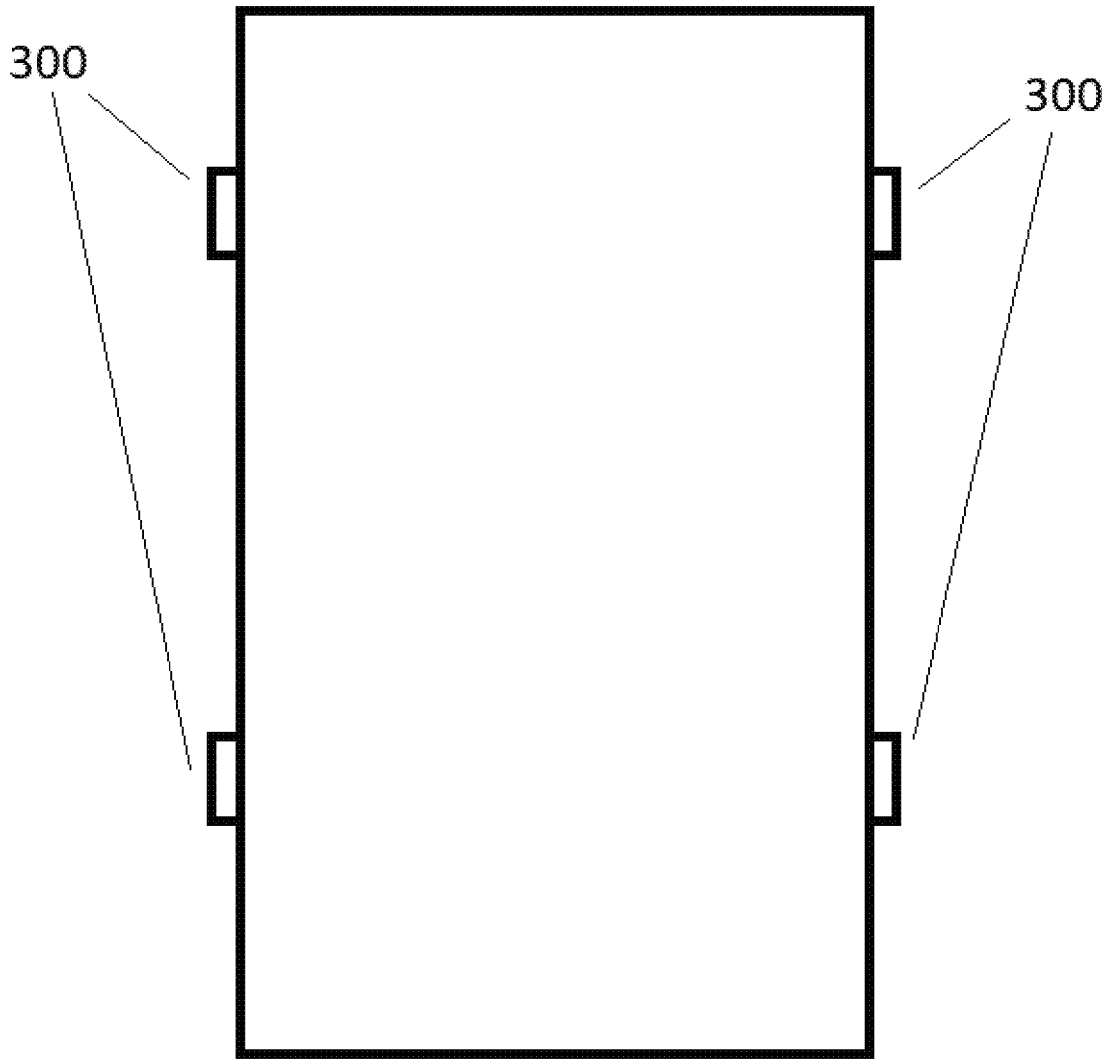
FIG. 3 shows a view of an embodiment of the present invention from the top.

In an embodiment shown in FIG. 3, one or more of the layers may comprise handles 300 to make the layer easier to flip. The handles may be made of strapping material or any other material that is strong enough to support the weight of the layer in question. The handles are preferably located in such a way as to provide two points of support for the layer as it is being flipped—for example, at ⅓ and ⅔ the length of the long side of the layer.

In the preferred embodiment, no fasteners are used to attach the two layers to each other; this simplifies the design and makes it easier for the two layers to be used in either configuration. Similarly, no mattress cover is used in the preferred embodiment; rather, the two layers are simply stacked on top of each other. Putting a mattress cover on a mattress is generally a very difficult task for a consumer in the home, so omitting the mattress cover simplifies the steps of reconfiguring the mattress.

Exemplary embodiments are described above. It will be understood that the present invention encompasses other reasonable equivalents to the embodiments described above, as is evident to a person of reasonable skill in the art of mattress design.

The invention claimed is:

1. A method of assembling a modular mattress, the modular mattress comprising:

a first layer, wherein the first layer is a sheet with two distinct surfaces having distinct firmness levels, wherein the first layer comprises a top surface and a bottom surface;

a second layer, wherein the second layer is a sheet with two distinct surfaces having distinct firmness levels, wherein the second layer comprises a top surface and a bottom surface;

wherein a length of the first layer is approximately the same as a length of the second layer, and a width of the first layer is approximately the same as a width of the second layer;

wherein the top surface of the first layer has a firmness level that is different from the bottom surface of the first layer;

wherein the top surface of the second layer has a firmness level that is different from the bottom surface of the second layer, the top surface of the first layer, and the bottom surface of the first layer;

wherein the method of assembling the modular mattress comprises:

at a first time, placing the first layer on top of the second layer, wherein the bottom surface of the first layer is in contact with the top surface of the second layer;

at a second time distinct from the first time, repositioning the first layer and the second layer in at least one of the following ways:

placing the second layer on top of the first layer, wherein the bottom surface of the second layer is in contact with the top surface of the first layer;

placing the second layer on top of the first layer, wherein the top surface of the second layer is in contact with the top surface of the first layer.

2. The method of claim 1, wherein the top surface of the first layer has a visual appearance that is distinct from the bottom surface of the first layer, and wherein the top surface of the second layer has a visual appearance that is distinct from the bottom surface of the second layer, wherein the visual appearance may be one or more of the following group: color, pattern.

3. The method of claim 1, further comprising:

placing a non-slip sheet between the first layer and the second layer.

4. The method of claim 3, wherein the non-slip sheet is one of the following: hook and loop fastener, non-skid pad.

5. The method of claim 1, wherein:

the top surface of the first layer is one of the following group: innersprings, memory foam, latex foam, gel, memory foam, firm high-density foam, soft high-density foam;

the bottom surface of the first layer is one of the following group, and distinct from the top surface of the first layer: innersprings, memory foam, latex foam, gel, memory foam, firm high-density foam, soft high-density foam;

the top surface of the second layer is one of the following group, and distinct from the top surface of the first layer and the bottom surface of the first layer:

innersprings, memory foam, latex foam, gel, memory foam, firm high-density foam, soft high-density foam;

and the bottom surface of the second layer is one of the following group, and distinct from the top surface of the first layer, the bottom surface of the first layer, and the top surface of the second layer: innersprings, memory foam, latex foam, gel, memory foam, firm high-density foam, soft high-density foam.

6. The method of claim 1, wherein at least one of the first layer and the second layer comprises at least one handle.

7. The method of claim 6, wherein each one of the first layer and the second layer comprises a first long side and a second long side parallel to the first long side, wherein each one of the first layer and the second layer comprises two handles located at approximately ⅓ and ⅔ points of a length of the first long side and the second long side.

8. The method of claim 1, wherein the mattress does not comprise any fasteners between the first layer and the second layer.

9. The method of claim 1, further comprising:

at a third time distinct from the first time and second time, repositioning the first layer and the second layer in at least one of the following ways:

placing the first layer on top of the second layer, wherein the bottom surface of the first layer is in contact with the top surface of the second layer;

placing the second layer on top of the first layer, wherein the bottom surface of the second layer is in contact with the top surface of the first layer;

placing the second layer on top of the first layer, wherein the top surface of the second layer is in contact with the top surface of the first layer;

placing the first layer on top of the second layer, wherein the top surface of the first layer is in contact with the top surface of the second layer;

placing the first layer on top of the second layer, wherein the bottom surface of the second layer is in contact with the bottom surface of the first layer.

* * * * *